United States Patent [19]

Torres

[11] Patent Number: 4,946,016

[45] Date of Patent: Aug. 7, 1990

[54] DEVICE FOR CONTROLLING POSITIONED STOPPING OF A PACKAGING UNIT

[75] Inventor: Jean Torres, Lausanne, Switzerland

[73] Assignee: SAPAL Societe Anonyme des Plieuses Automatiques, Ecublens, Switzerland

[21] Appl. No.: 262,553

[22] Filed: Oct. 25, 1988

Related U.S. Application Data

[63] Continuation-in-part of Ser. No. 919,023, Oct. 15, 1986, now abandoned.

[30] Foreign Application Priority Data

Oct. 16, 1985 [CH] Switzerland ..... 4453/85

[51] Int. Cl.[5] ..... F16D 47/00

[52] U.S. Cl. ..... 192/48.2; 74/813 R; 192/48.3; 464/45

[58] Field of Search ..... 192/48.3, 48.2; 74/665 GE, 819, 817, 816, 813 R; 464/45; 493/34

[56] References Cited

U.S. PATENT DOCUMENTS

| | | | |
|---|---|---|---|
| 1,983,827 | 12/1934 | Winther et al. | 192/48.3 |
| 2,463,100 | 3/1949 | Gredell | 192/48.3 X |
| 2,694,937 | 11/1954 | Birbaum | 192/48.3 X |
| 2,781,118 | 2/1957 | Pechy | 192/150 |
| 2,981,118 | 4/1961 | Morrill | 192/48.3 X |
| 3,072,234 | 1/1963 | Maurice et al. | 192/48.3 |
| 3,251,442 | 5/1966 | Aschauer | 192/48.3 |
| 3,498,434 | 3/1970 | Richmond | 192/150 |
| 3,613,858 | 10/1971 | Cox | 198/341 |
| 4,321,991 | 3/1982 | Teijido et al. | 192/56 R |
| 4,526,257 | 7/1985 | Mueller | 192/48.3 X |

*Primary Examiner*—Rodney H. Bonck
*Attorney, Agent, or Firm*—Frost & Jacobs

[57] ABSTRACT

A control device comprises a clutch having two parts which are respectively coupled with an input shaft and an output shaft. The input shaft carries a torque limiter having a rotating pulley coupled with a central axle by a friction member. The rotating pulley is connected to the output shaft, and the central axis is connected to the input shaft. In case of disengagemnt of the output shaft, with the input shaft always being in rotation, a limited couple is transmitted to the part of the clutch coupled to the output shaft through the torque limiter in order to cause the part to attain a given position on abutment.

3 Claims, 1 Drawing Sheet

DEVICE FOR CONTROLLING POSITIONED STOPPING OF A PACKAGING UNIT

CROSS-REFERENCE TO RELATED APPLICATION

Figure 1:
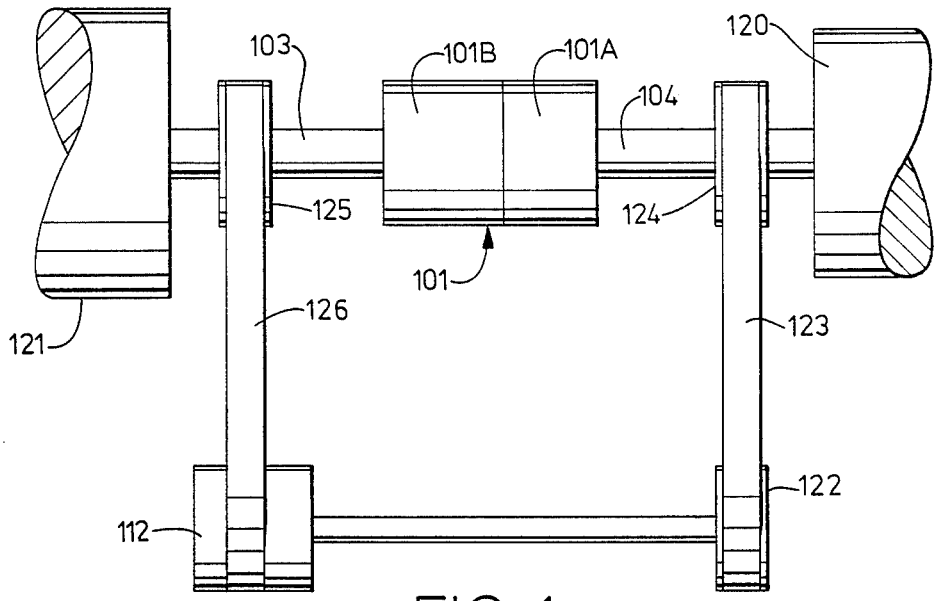

This application is a continuation-in-part of application Ser. No. 919,023, filed Oct. 15, 1986, and now abandoned.

The present invention relates to a device for controlling positioned stopping of a packaging unit comprising a first machine, for example, a unit-packaging machine and a second machine, for example, a group-packaging machine, this device comprising a clutch consisting essentially of a first part connected to a first shaft, called the input shaft, coupled with the first machine, and a second part connected to a second shaft, called the output shaft, coupled with the second machine.

Packaging lines usually comprise packaging machines which individually package unit products. These machines may be controlled in two different ways. They are either continuously driven at the same speed and a product detector indicates the possible absence of products and controls momentary stopping of the supply of packaging material, or they are driven discontinuously as a function of arrival of the products.

In both cases, the line may further comprise a detector for improperly packaged products, which are ejected.

A group-packaging machine, for example a cartoner or board packer, ensures the boxing of product lots. These lots must of course comprise a constant number of products. When the supply presents "gaps", the group-packaging machine must be put on stand-by. Restarting must be effected in synchronism with the unit-packaging machine or machines.

The devices for positioned stopping of this type must allow the output shaft to be stopped. In other terms, whatever the speed of rotation of the input shaft may be, it must be made possible for the output shaft to be stopped in an angular position which is defined with respect to the input shaft, in order to enable restarting the output shaft, in phase with the input shaft, after any halt of this output shaft. The moment of starting off the drive mechanism of the output shaft is determined by an electronic device which selects the moment as a function of the speed of the input shaft.

As previously mentioned, the output shaft is coupled for example with a machine for boxing products previously packaged by a packaging machine such as an automatic folder or the like. Between the supply line and the boxing machine, a station is generally inserted for controlling the conformity of the products. When this station ejects the non-conforming products, the sequence of products delivered to the boxing machine is interrupted. The presence of "gaps" in the column of products may constitute one of the causes of stopping the boxing machine. Such a halt must be effected in a precise position, in such a manner that restarting may be operated in synchronism with the supply line which continues to be driven during the above described halt.

In practice, the known devices do not always permit the desired positioning halting. In particular, certain clutches require that the speed of rotation be sufficiently high to attain this position, which a too low speed does not allow, since the stored kinetic energy is insufficient to bring the corresponding shaft to the desired position.

This fact constitutes an important drawback for which the present invention has the object of providing a remedy.

To this end, the control device according to the invention is characterized in that it comprises a torque limiter inserted between the second part of the clutch and the input shaft.

Figure 2:
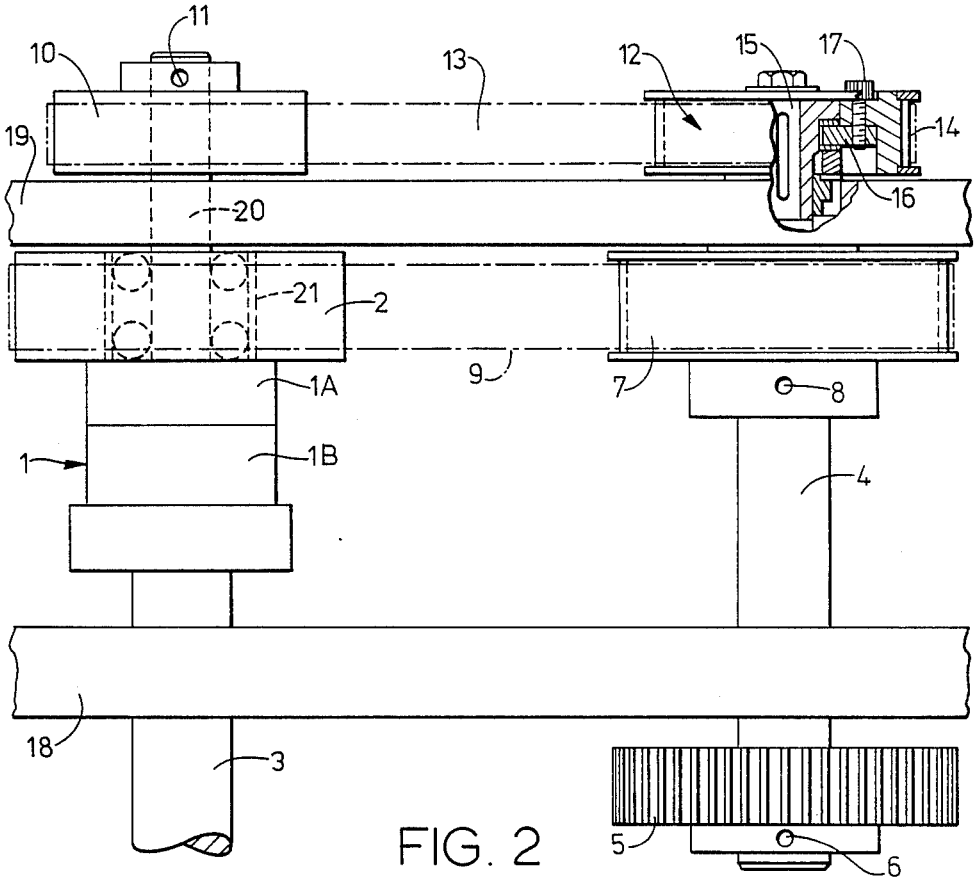

The present invention will be better understood with reference to the description of an example of an embodiment and the accompanying drawings wherein:

FIG. 1 represents a schematic view illustrating the principle of the invention, and FIG. 2 schematically represents a preferred embodiment of the device according to the invention.

According to the FIG. 1 the device represented comprises a clutch 101 with an integrated brake comprising a first part 101A and a second part 101B which are respectively coupled to an input shaft 104, and an output shaft 103. The input shaft is coupled to a packaging machine 120 such as an automatic folding apparatus. The output shaft is coupled to a boxing machine 121. It is to be noted that the folding apparatus is working continuously, but the boxing machine may be stopped for different reasons, like the discontinuity of the arrival of products to be boxed.

It is absolutely necessary for the shaft 103 to be stopped in a predetermined position, or to be brought, during the stopping time in said predetermined position so that restarting may be operated in synchronism with the shaft 104 which is still running.

The clutch 101, which is of an electro-magnetic type comprises an electromagnetically activated detent. If the kinetic energy of the shaft 103 is great enough to bring it to the predetermined position defined by the detent, there is no need to use other external forces to reach this position. But in the most cases, the kinetic energy is not great enough and an external force must be used for rotating the shaft 103 to the predetermined stopping position. This external force is provided by a friction torque limiter 112 which is coupled with a pulley 122 by a belt 123 to a pulley 124 fixed on the input shaft 104 and which is coupled with a pully 125 by a belt 126 to the output shaft 103.

The torque limiter 112 constitutes a device for generating the required external force for rotating the shaft 103 to the predetermined stopping position. From the moment when said position is reached, the friction torque limiter rotates without transmitting its rotation to the part 101B of the clutch 101, as hereinafter described with reference to FIG. 2.

The control device represented in the FIG. 2 is mounted for example on a product transport line of the packaging machine (not shown) and an automatic boxing machine (not shown) for these products. However, this example is not limiting and the device may be employed in numerous other fields of utilization.

The FIG. 2 illustrates this device which essentially comprises an engaging and disengaging brake, for example of the type commercialized under the appellation WARNER CB-6, composed of two parts, of which the first part 1A is solid with a pulley 2 mounted as a free wheel on a shaft 3, the so-called output shaft, and whose second part 1B is solid with the output shaft 3. The pulley 2 is mounted on a part 20 of the shaft 3 having a smaller diameter by means of a ball bearing 21. The latter is coupled to the boxing machine which is, in principle, driven by the motor of the packaging machine.

A shaft called the input shaft 4 carries on one hand a pulley 5 made solid with this shaft, for example by a pin 6 and on other hand a pulley 7 made solid with this shaft, for example by a pin 8. The pulley 5 is coupled with the packaging machine (not shown), and is preferably driven by the motor of the latter. The pulleys 2 and 7 are coupled by means of a belt 9, a chain or any other appropriate coupling member.

The output shaft 3 moreover carries a second pulley 10 made solid with this shaft by means of a pin 11 and the input shaft 4 carries a friction torque limiter 12 coupled with a pulley 10 by a belt 13, a chain, or any other appropriate coupling member.

The torque limiter 12 essentially comprises a rotating pulley 14 mounted on a central axle 15 and a friction member 16 arranged for coupling the rotating pulley with the central axle. An adjusting member 17 allows the limiting couple or the threshold of the torque limiter to be defined. The central axle 15 is solid with the input shaft. The rotating pulley 14 is coupled with the pulley 10 by means of the belt or chain 13.

These components are supported together by two beams 18 and 19 constituting a part of the support frame of the machine or of a support structure coupled to the support frame.

In the illustrated example, the input shaft coupled with the packaging machine, for example an automatic folding unit driven at a more or less high speed. In the case of disengagement of the ouput shaft 3, with a view to stopping the boxing machine, the input shaft 4 continues to rotate and drives the torque limiter 12 which transmits a couple to the output shaft 3 and brings the latter into the determined position which will subsequently allow restarting of this shaft, in phase with the input shaft. This torque is transmitted by the belt 13 to the pulley 10 coupled with the outer shaft 3. In practice, the torque limiter enters into action only when the driving speed of the ouptput shaft is low and the kinetic energy is insufficient to bring this shaft into the appropriate position defined by a stop within the clutch.

When the speed is sufficiently high, the part 1B of the clutch coupled to the output shaft is brought directly into abutment at the moment when the output shaft is disengaged and the torque limiter, which in this case does not exert the previously mentioned assisting function, slips due to the fact that its central axis 15 is driven with the input shaft 4 and that the rotating pulley 14 is stopped.

The device as described allows the output shaft to be brought to a halt in a predetermined position in all cases, so that the boxing machine may be restarted in perfect synchromism with the packaging machine after a halt, during which this packaging machine has remaind in operation.

What is claimed is:

1. A device for controlled positioned stopping of a packaging unit comprising a first packaging machine and a second packaging machine, said device comprising a clutch having a first part connected to a first shaft functioning as an input shaft and coupled with said first packaging machine, and a second part connected to a second shaft functioning as an output shaft and coupled with said second packaging machine, a torque limiter inserted between said second part of said clutch and said input shaft, means coupling said torque limiter with said input shaft, and means coupling said torque limiter with said output shaft, said first part of said clutch being rotatably mounted on said output shaft and said second part of said clutch being fixedly mounted on said output shaft, said torque limiter comprising a rotating pulley mounted on a central axle, and a friction member arranged for coupling said rotating pulley with said central axle, said pulley being coupled with said second part of said clutch, and said central axle being coupled with said input shaft.

2. The device according to claim 1, wherein said torque limiter includes means for adjusting the drive torque.

3. The device according to claim 1, wherein said output shaft carries a pulley coupled with said rotating pulley of said torque limiter.

* * * * *